US005802744A

United States Patent [19]

Kampmann et al.

[11] Patent Number: 5,802,744

[45] Date of Patent: Sep. 8, 1998

[54] METHOD OF AND AN APPARATUS FOR RECONSTRUCTING RAILWAY TRACK SYSTEMS

[76] Inventors: Werner Kampmann, Karwendelstr. 6, 82377 Penzberg; Herbert Heitkamp, Lutkchcidc 80, 59368 Werne; Klaus Linde, Solbacher Str. 142, 57078 Siegen; Werner Schmidt, Mittlerer Weg 62, 74564 Crailsheim; Fritz J. Schmidt, Gustav-Adolf-Str. 1, 73033 Goppingen; Franz Oppel, Bergackerstr. 19, 74597 Stimpfach; Jurgen Rieger, Konigsberger Str., 97990 Weikersheim, all of Germany

[21] Appl. No.: 649,607

[22] PCT Filed: Nov. 11, 1994

[86] PCT No.: PCT/DE94/01353

§ 371 Date: Oct. 24, 1996

§ 102(e) Date: Oct. 24, 1996

[87] PCT Pub. No.: WO95/15418

PCT Pub. Date: Jun. 8, 1995

[30] Foreign Application Priority Data

Dec. 4, 1993 [DE] Germany ..... 43 41 418.4

[51] Int. Cl.[6] ..... E02F 5/04

[52] U.S. Cl. ..... 37/104; 171/16

[58] Field of Search ..... 37/91, 104, 195, 37/DIG. 20, 105, 106, 107; 104/2, 5, 12, 7, 7.3; 171/16

[56] References Cited

U.S. PATENT DOCUMENTS

| | | | |
|---|---|---|---|
| 3,750,409 | 8/1973 | Orfei | 61/41 |
| 3,967,396 | 7/1976 | Maisonneuve et al. | 171/16 X |
| 4,042,035 | 8/1977 | Boyer | 171/16 |
| 4,094,249 | 6/1978 | Theurer et al. | 171/16 X |
| 4,502,389 | 3/1985 | Theurer et al. | 171/16 X |
| 5,109,775 | 5/1992 | Kershaw et al. | 171/16 X |

FOREIGN PATENT DOCUMENTS

| | | |
|---|---|---|
| 2622671 | 5/1976 | Germany . |
| 2658349 | 12/1976 | Germany . |
| 2810386 | 3/1978 | Germany . |
| 3443282 | 11/1984 | Germany . |

*Primary Examiner*—Michael J. Carone
*Assistant Examiner*—Robert Pezzuto
*Attorney, Agent, or Firm*—Vickers, Daniels & Young

[57] ABSTRACT

An apparatus for reconstructing railway track systems while simultaneously clearing away the bed of the old track system. A sliding seal driver is used to secure the trench formed by the removal of the old track foundation as the old track is cleared away. A new trench is cut as the apparatus proceeds on the same path as the old track. The seal driver includes lateral shields securing the trench walls as well as ground shields resting on the bottom of the trench. The lateral shields are of such lengths to secure the trench walls over the entire work area.

54 Claims, 5 Drawing Sheets

METHOD OF AND AN APPARATUS FOR RECONSTRUCTING RAILWAY TRACK SYSTEMS

BACKGROUND OF THE INVENTION

The invention relates to a method of reconstructing railway track systems, particularly multi-track installations, whereby, while clearing away the bed of the old track, a trench with side wall protection is cut and proceeds on the same path, the material for making the new track bed being introduced into that trench. Furthermore, the invention is concerned with an expedient apparatus for carrying out the method.

STATE OF THE ART

In practice, it is well known that to a great extent there is a problem of reconstructing existing railway track systems and/or their sub-grade. In this respect, mostly the entire sub-grade, in other words the entire track bed, has to be removed and remade. In view of the multiple or double track systems which are mostly involved, these works must be carried out while maintaining rail traffic on the existing tracks which makes the work of reconstruction considerably more difficult. Reconstruction can be carried out in such a way that while the old track bed is being cleared away, a trench is cut out, for example by means of an excavator, in which case it is necessary above all to secure the trench wall which is towards the adjacent track and this is achieved by means of sheet piles or protective walls. The materials for the bed of the new track are fed into the cutout and secure trench and compacted. It is then possible to lay a compacted bed of sand onto the bottom of the trench first, followed then by compacted crushed rock which forms the bed for the superstructure of the new track.

SUMMARY OF THE INVENTION

Above all, the object of the invention is to provide a method and an apparatus with which the aforesaid reconstruction works can be carried out in a technically perfect and reliable manner with high rates of advance.

According to the method of the invention, this problem is resolved in that for safeguarding the trench, a sliding cutting structure with bottom cutters resting on the trench bottom and with side cutters which serve to safeguard the side walls of the trench is used, the bottom and side cutters guided on a supporting frame being advanced under pressure by means of cutter cylinders disposed between them and the supporting frame, individually or in groups and in the direction of trench progress, before the supporting frame follows. Preferably, the trench floor is laid with a gradient towards the side of the trench and sufficient to drain off water.

For the reconstruction of track systems, the method according to the invention employs a sliding cutting structure which is basically known for cutter plate tunnelling but also for trench cutting. By applying this method to the reconstruction of track systems, it is possible to achieve considerable rates of progress, especially since the hitherto necessary work of installing sheet piling and the like becomes unnecessary. The sliding cutting structure provided according to the invention makes it possible reliably to secure the cut-out trench over a sufficiently long working path and also permits curves to be negotiated in order to adapt to the run of the track. At the same time, in the protection of the sliding cutting structure, the trench cutting work and/or the work of making up the new track bed can be carried out reliably and briskly. The supporting of the sliding cutting structure or its supporting frame on the trench floor, via the bottom cutters, results in a desirable smoothing and compaction of the trench floor and is favourable to the operation of the cutting structure as the tunnelling cutters push forward and also favourable to pulling on the supporting frame. It is recommended to carry out the method in such a way that behind the sliding cutting structure the trench floor is level before the new bed is incorporated, and this can be achieved by means of a pressure or levelling beam displaceably coupled to the sliding cutting structure or its supporting frame. With regard to reliable securing of the trench in the respective working zone and also the directional control facility of the sliding cutting structure, it is advantageous to use a multi-part cutting structure the supporting frame of which forms a leading frame to which a trailing frame is coupled by means of hydraulic follow-on cylinders and on which the side cutters are supported and guided by trailing cutters connected to them in articulating, preferably universally articulated fashion. In this respect, the trailing frame ideally rests on bottom cutters or on trailing bottom cutters which are articulatingly connected to the bottom cutters of the leading frame so that they are pulled along by sliding. Trench cutting or digging out the trench in the head zone of the sliding cutting structure can take place by using an excavator or even by means of an excavating implement mounted on the supporting frame of the cutting structure.

By means of the reconstruction method according to the invention, the reconstruction work can be reliably and briskly carried out at a high rate of progress while rail traffic on the neighbouring track is maintained, reliable supporting of the track bed of the neighbouring track which is used for rail traffic being retained.

The apparatus provided for carrying out the method according to the invention comprises, in accordance with the foregoing, a sliding cutting structure which secures the trench for preparation of the new track bed and which comprises, guided on the supporting frame, bottom and side cutters and associated hydraulic cutting cylinders which are disposed articulating between the common supporting frame and the individual cutters, as is known in the case of blade cutters. In this respect, the side cutters are ideally much longer than the bottom cutters so that they project both at the front and also at the rear beyond the supporting frame and the bottom cutters and so reliably secure the side walls of the trench both in the region of the trench cutting and also in the area where the new track bed is being introduced. The bottom cutters are expediently disposed at close intervals from one another so that they cover substantially the whole area of the trench floor, which on the one hand results in friction conditions which are favourable to the operation of the cutting structure and on the other ensures that the trench floor is substantially flattened by the bottom cutters which are supported on it.

The supporting frame of the cutting structure provided according to the invention is ideally so constructed that it does not project, or does so only slightly, upwards out of the trench. Ideally, it has a substantially U-shaped cross-section of which the flat part of the frame, forming the web of the U, has on the under side guides for the bottom cutters while the side parts which form the two arms of the U and which project beyond the flat part of the frame are provided with guides for the side cutters. The necessary pump sets for supplying the hydraulic consumer units as well as other devices can be mounted on the flat part of the frame. As mentioned, the cutting structure is preferably so constructed that its supporting frame forms a leading frame to which a trailing frame is coupled by means of hydraulic follow-on cylinders, so that once the supporting frame has moved forward by one working step the follow-on cylinders provide a catch-up facility. Trailing cutters are connected by articulating means to side cutters guided on the leading frame, being laterally supported and guided on the trailing frame. The articulating means are preferably constructed as cardan or universal joints so that the trailing cutters are connected to the leading cutters in such a way that they can pivot about a vertical axis as well as about an axis extending in the transverse direction of the trench. The trailing frame may be substantially shorter than the preceding supporting or leading frame. It is furthermore recommended to articulate on the outer bottom cutters trailing bottom cutters on which the trailing frame slides so that also pulling up the trailing frame when the leading or supporting frame is stationary is facilitated. The trailing cutters of the side cutters are advantageously so constructed that they project rearwardly beyond the trailing frame and into the open trench and thus secure the trench space for incorporation of the new track bed.

According to a further advantageous development feature of the invention, hook-on claws or the like which can be applied preferably hydraulically to the floor of the trench are disposed on the supporting frame of the cutting structure, expediently towards the rear on the supporting or leading frame and on both sides of the frame axis. The hook-on claws preferably consist of hook-on plates which have spikes or the like on their under side and which are disposed on the supporting frame in such a way that they can be vertically adjusted, the height setting and the pressure applied against the trench bottom expediently being by means of hydraulic adjusting cylinders. By means of these hook-on claws or plates, so the supporting or leading frame can be anchored to the trench floor so that the requisite forward propulsion of the tunnelling cutters by means of the cutter cylinders can also be reliably guaranteed even at a low trench height with a correspondingly low structural height of the sliding cutting structure. At the same time, the hook-on claws may also be used for lateral control of the cutting structure.

Behind the supporting frame or the trailing frame coupled to it, it is expedient to provide a pressure and levelling beam adapted for movement over the trench floor and which is coupled to the supporting frame by means of hydraulic rams and with the help of which therefore the trench floor can be equalised and levelled before the materials for making the new track bed are placed into the trench. The pressure and levelling beam is expediently so constructed that it is guided on the side cutter s or trailing cutters.

For controlling the sliding cutting structure which is provided according to the invention, while preserving a reliable supporting of the trench wall on the neighbouring track side, on which rail traffic is being maintained during the reconstruction work, various measures can be adopted. As is known per se in the case of blade cutters, this can be achieved by an appropriate control of the forward movements of the side cutters so that during forwards propulsion of the outer side cutter the supporting frame becomes slightly tilted in the trench and therefore the inner side cutter (or side cutters) on the same side as the neighbouring track will, by reason of being guided on the supporting frame, assume a certain inclined attitude in the direction of the trench wall. Also, control can be achieved by unilateral claw engagement of the supporting or leading frame with the aid of the respective hook-on claw or plate. Furthermore, there is the possibility of making the supporting frame slightly conical so that it tapers conically towards the rear so that it can assume a certain inclined position in relation to the trench axis and in the direction of the inner trench wall. Furthermore, it is possible for the end of the inner side cutter or cutters to be fitted with wedge-shaped cutting edges or shoes which are so constructed that upon forward propulsion the side cutter(s), utilising the clearance in the cutter guides, perform an engagement movement in the direction of the inner trench wall. The follow-on or forward feed of the supporting frame or trailing frame respectively are generally performed by means of the cutter cylinders disposed on it and which are constructed as double-acting hydraulic rams. During forward propulsion of the cutters, the supporting frame can also be stabilised in its position by being supported via the said pressure and levelling beam, this beam being for example braced against the material incorporated and already compacted in the trench and intended for the new track bed. Also, forward movement of the supporting frame in the working direction can be assisted by the thrust piston transmission associated with the pressure and levelling beam.

Further advantageous development features of the invention are indicated in the individual claims and arise from the ensuing description of the example of embodiment shown in the accompanying drawings.

BRIEF DESCRIPTION OF THE DRAWINGS

Reference may now be made to the drawings, which illustrate various embodiments that the invention may take in physical form and in certain parts and arrangements of parts wherein.

DETAILED DESCRIPTION OF THE PREFERRED EMBODIMENTS

Figure 1:
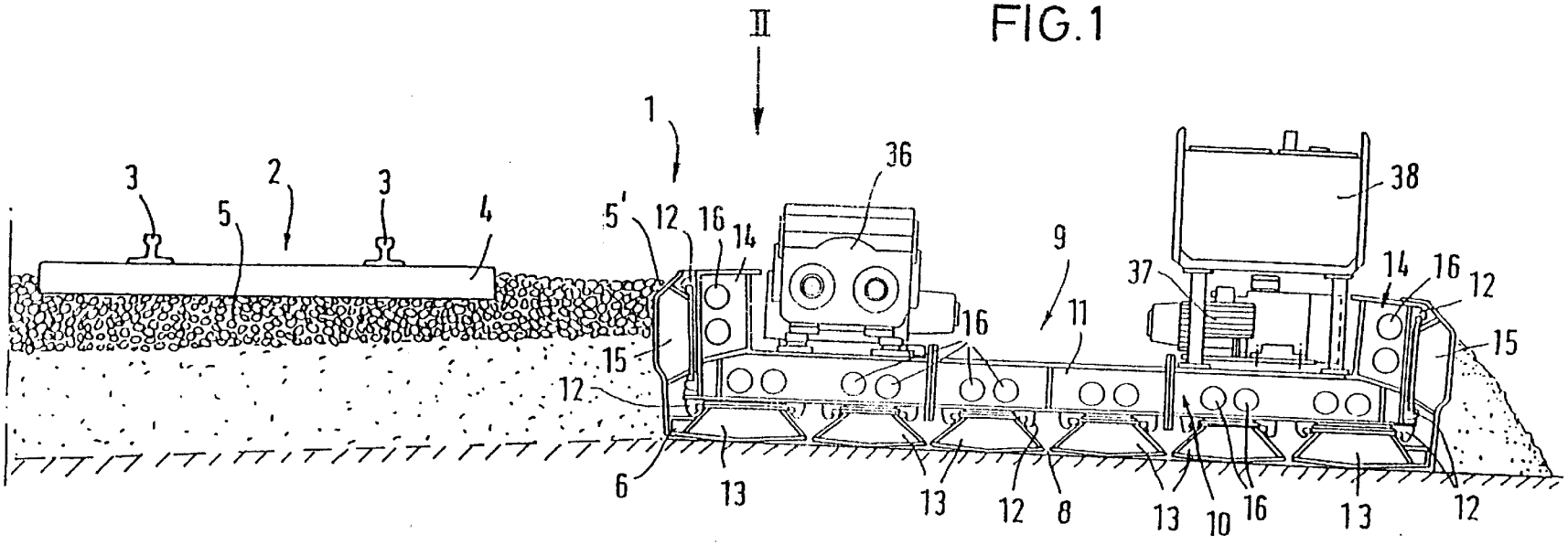
FIG. 1 is a cross-section through a twin-track railway track system requiring reconstruction, together with a sliding cutting structure according to the invention.

Referring now to the drawings, wherein the showings are for the purpose of illustrating the preferred embodiments of the invention only and not for the purpose of limiting the same, FIG. 1 illustrates a twin-track system 1 requiring reconstruction and with the track 2 which serves to maintain rail traffic while the reconstruction work is being carried out on the neighbouring track extending parallel with it and which, together with its track superstructure, has already been removed in the area in which the reconstruction work is being performed. The track superstructure consisting of the rails 3 and the sleepers 4 rests in the usual way on the track bed which is formed by a compacted bed 5 of crushed rock which in turn can rest on a compacted bed of sand. It can be seen from FIG. 1 that the track bed 5 is, on the floor, inclined outwardly (to the left) at a small angle so that water from the track bed can drain off in this direction.

Figure 2:
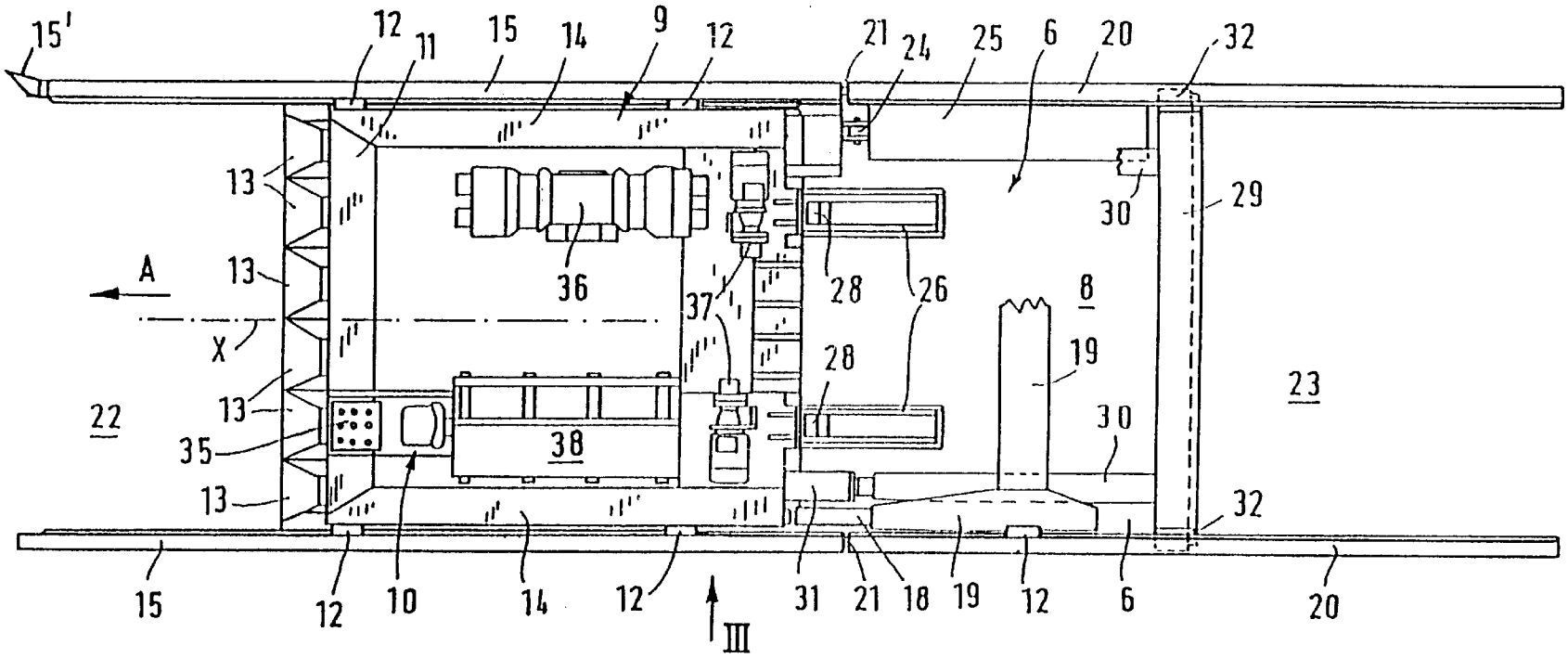
FIG. 2 shows the sliding cutting structure in FIG. 1 in a plan view in the direction of the arrow II in FIG. 1.
Figure 3:
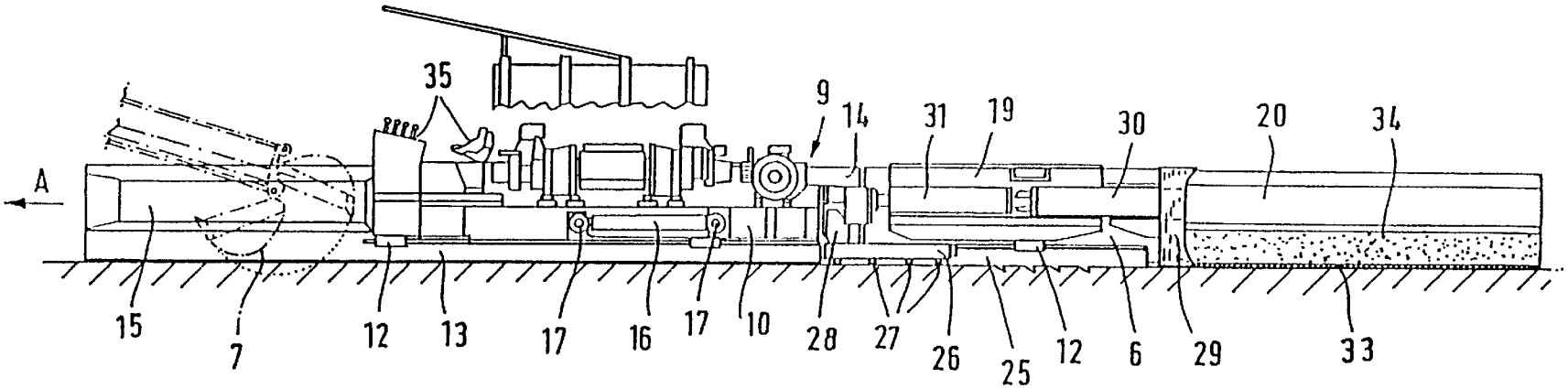
FIG. 3 shows the sliding cutting structure in a side view in the direction of the arrow II in FIG. 2.

At the time of reconstructing the neighbouring track, its entire track bed, possibly right down into the soil, must be cleared away, a trench 6 being cut out which can be achieved by using a mobile excavator, of which only the excavator blade 7 disposed on the excavator jib is shown in FIG. 3. The trench 6 is so cut out that its trench floor 8 is inclined towards the side remote from the track 2, in other words towards the outside, for draining water from the newly laid track bed. The inner side wall of the trench 6 is in its upper part constituted by the compacted bed 5 of crushed rock and supporting the neighbouring track 2. The working direction when performing the reconstruction work or the direction in which the trench 6 is cut out during the course of the reconstruction work, is indicated by the arrow A in FIG. 2.

In the respective area of reconstruction, the trench 6 is secured by means of a sliding cutting structure 9 which comprises flat or shallow supporting frame 10 the height of which corresponds substantially to the depth of the trench 6 and which, as FIG. 1 shows, has a substantially U-shaped cross-section, the flat frame part 11 of which, forming the web of the U having on its under side cutter guides 12 for bottom cutters 13 disposed closely adjacent one another and with which the supporting frame 10 is supported on the inclined trench floor 8. The parallel bottom cutters 13 form between the two trench walls a substantially all-over covering of the trench floor 8. The flat frame part 11 of the supporting frame 10 has on both sides projecting rigid side parts 14 which form the two arms of the U-shaped supporting frame and on each of which a side cutter 15 is guided in a cutter guide 12. If the trench is relatively deep, then it is possible naturally to have a plurality of side cutters 15 disposed above one another on the supporting frame or on the side parts 14 thereof, in each case disposed in a cutter guide. As in the case of cutter blades, the cutter guides 12 are guides consisting of T-shaped grooves. Associated with each bottom cutter 13 and side cutter 15 is at least one cutter cylinder 16 or, in the case of the embodiment shown (FIG. 1), a pair of cutter cylinders. The cutter cylinders 16 consist of double-acting hydraulic rams. As FIG. 3 shows, they are connected at one end to the supporting frame 10 in articulations 17 and at the other to the associated cutters 13 or 15. Via the control provided by the cutter cylinders 16, therefore, the bottom cutters and side cutters 15 can be propelled forwards individually and independently of one another or also in groups in respect of the stationary supporting frame 10, in the working direction indicated by the arrow A and by the cylinder travel of the cutter cylinders. When all the cutters 13 and 15 are advanced, then by the application of pressure to the cutter cylinders 16 in the push-in direction, the supporting frame 10 will follow on in the working direction A, the cutters 13 and 15 forming the forward-pull abutment for the supporting frame 10 by virtue of the frictional engagement with the trench floor or trench walls. This mode of operation is familiar in the case of cutting blades.

The supporting frame 10 of the sliding cutting structure forms a leading frame to which a trailing frame 19 is coupled by hydraulic follow-on cylinders 18, the trailing frame being shown in FIG. 2 on only one side of the trench axis X while being constructed symmetrically in relation to the said axis X. Accordingly, the trailing frame 19 is on both sides of the trench axis X which coincides with the longitudinal axis of the cutting structure, connected by respective hydraulic follow-on cylinders 18 to the supporting and leading frame 10. Both follow-on cylinders 18 expediently likewise consist of double-acting hydraulic rams. It can be seen that the trailing frame 19 has a shorter overall length than the supporting or leading frame 10. Furthermore, FIG. 2 in particular shows that at the rear ends of the side cutters 15 there are cutter extensions in the form of so-called trailing cutters 20 which are connected at joints 21 which are preferably constructed in the manner of universal joints so that articulating movements between the cutters 15 and the trailing cutters 20 are possible both in the vertical as well as in the lateral direction. The trailing cutters 20 are guided in cutter guides 12 on the trailing frame 19. Accordingly, the side cutters 15 and their articulatingly connected trailing cutters 20 are laterally supported both on the supporting or leading frame 10 as well as on the trailing frame 19 and are guided for displacement with clearance in the tunnelling direction (arrow A). It can be seen from FIG. 2 that, at the front, the side cutters 15 project beyond the supporting or leading frame 10 and consequently support the trench walls in the frontal working space 22, where the trench 6 is being cut. Furthermore, FIG. 2 shows that the trailing cutters 20 connected to the side cutters 15 project rearwardly (in opposition to the direction of the arrow A) and beyond the trailing frame 19 so securing the trench walls in a rear working space 23 in which the new track bed is erected. Furthermore, FIG. 2 show s that the side cutters 15, including their trailing cutters 20, are of a substantially greater length than the bottom cutters 13, the length of which corresponds substantially to the overall length of the supporting or leading frame plus the travel of the cutter cylinders 15. Only on the two outer bottom cutters 13 which are disposed on the side of the two trench walls is a trailing bottom cutter 25 connected in vertically pivotable manner in an articulating means 24, the trailing bottom cutter 25 likewise being braced on the trench floor 8. The two parallel trailing bottom cutters 25 form a sliding support for the trailing frame 19 which is thus supported in sliding manner on the trailing bottom cutters 25. The trailing bottom cutters 25 end upstream of the rear working space 23 so that here the trench floor 8 is exposed over its entire width.

Symmetrically in relation to the axis X there are at the rear of the leading or supporting frame 10 or its frame part 11 two ho ok-on claws 26 which, as FIG. 3 in particular shows, are constructed as hook-on plates which have on their under side spikes 27 or the like. The two hook-on claws or plates 26 are respectively adapted for vertical adjustment on the supporting or leading frame 10 so that by means of a hydraulic setting cylinder 28 they can be pressed against the trench floor 8 in order to establish a position or can be lifted out of this working position so that they have no contact with the trench bottom. Preferably, the hook-on claws or plates 26 are respectively mount ed in a vertical guide for height adjustment and the supporting or leading frame 10 and can be actuated by means of the cylinder 28. In the hooked-on position, therefore, the supporting or leading frame 10 is stabilised in its position by the hook-on claws 26 so that the cutters 13, 15 can be pushed forwards in the working direction A by the cutter cylinders without the supporting or leading frame 20 being pushed back undesirably in the trench 6.

As FIGS. 2 and 3 show, there is behind the trailing frame 19 of the cutting structure and in the trench a pressure and levelling beam 29 by means of which the trench floor 8 can be smoothed or levelled out before the new track bed is introduced into the working space 23. In particular, this also means that the impressions in the trench floor which are brought about by the hook-on claws 26 are smoothed out. In the trench, the pressure and levelling beam 29 constitutes the end boundary of the working space 23. It has pointing in the direction of the pointing or leading frame 10 beam attachments 30 to which it is connected via double acting hydraulic displacement cylinders 23 respectively on the supporting and leading frame 10 so that when the supporting and leading frame 10 is stationary, it can be moved over the trench floor in both directions by means of the cylinders 31 in order to level out the trench bottom. FIG. 2 shows that the pressure and levelling beam 29 is at its two opposite sides guided laterally at 32 on the trailing cutters 20 and that consequently the trailing cutters 20 can also find a means of support on the pressure and levelling beam.

During performance of the reconstruction works, in the region of the front working space 22, the trench is cut out for example by means of the excavator (excavator shovel 7), the track bed of the old track being removed. During this work, it is recommended that the crushed rock bed 5 on the side of the inner side cutter 15 which is towards the neighbouring track 2 be cleared to such an extent that this side cutter 15 can be pushed forward by its cutter cylinder without hindrance from compacted crushed rock. The advancing position of the two side cutters 15 is indicated by broken lines in FIG. 2. As soon as the trench has been substantially cleared out in the working space 22, the side cutters 15 are jointly or individually one after the other pushed forward in the direction A of advance by the travel of the cutter cylinders, whereupon the bottom cutters 13 are by means of the cutter cylinders 16 associated with them, likewise pushed forward in the direction A singly or group-wise. During the advancing movement, the bottom cutters 13 and side cutters 15 with their trailing cutters 20 are guided on the leading or supporting frame 10 as well as on the trailing frame 19. The leading or supporting frame 10 is in this case stabilised in its position by the hook-on claws 26 being lowered towards the trench floor 8. Once all the trench cutters 13, 15, 29 have been pushed forward by the travel of the cutter cylinder, then after the hook-on claws 26 have been disengaged, the supporting or leading frame 10 can be pulled up by the cutter cylinder travel in the working direction A by means of the cutter cylinders. The forward movement of the supporting or leading frame 10 can be assisted by the displacement cylinders 31 of the pressure and levelling beam 29 which is supported in the working space 23 while this is happening, e.g. on the new track bed already installed or on some other supporting abutment. After forwards movement of the supporting or leading frame 10, then, the trailing frame can be brought up on the trailing bottom cutters 25 with a sliding movement employing the follow-on cylinders 18.

As mentioned, the new track bed is incorporated into the working space 23 while the trench walls are being secured. While this is happening, firstly a thin covering, for example a fleece, a layer of clay or the like 33 (FIG. 3) is deposited on the smooth trench floor 8 as a layer which is impervious to water and a sand bed 34 is then applied to this, and can be compacted for instance by means of a riddling plate, a roller or the like. Then, a bed of crushed rock can be laid on the compacted sand bed and this is likewise compacted in usual manner and onto this the superstructure for the new track is then laid. The sliding cutting structure can be controlled from a control stand 35 on the supporting or leading frame 10. On this frame there are furthermore pump assemblies 36 and 37 to supply the various hydraulic thrust piston transmissions of the sliding cutting structure. Furthermore, there is on the frame 10 a tank 38 which contains hydraulic fluid to supply the pump sets and the thrust piston transmissions.

Figure 4:
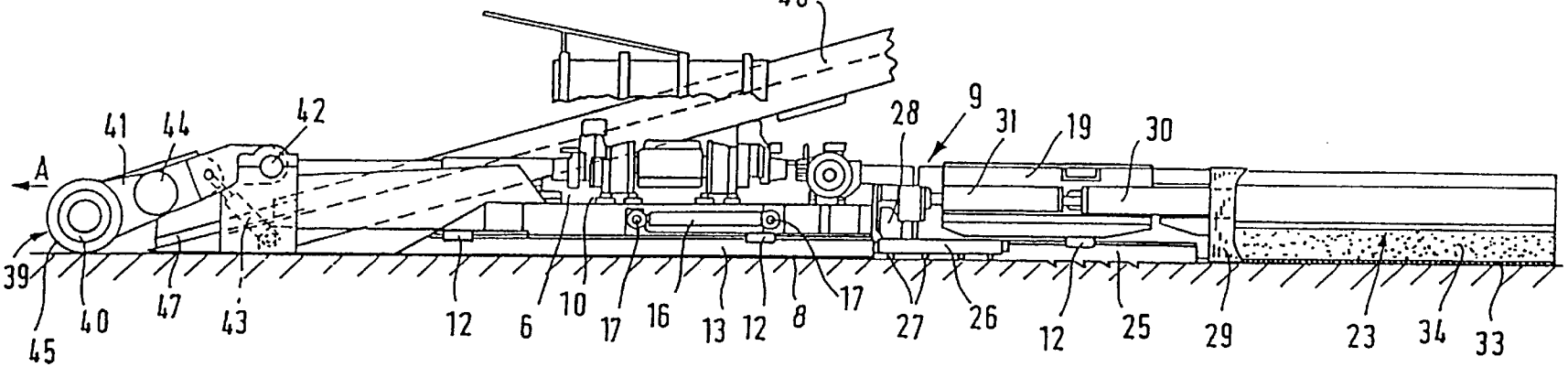
FIG. 4 is a plan view according to FIG. 2 showing the sliding cutting structure together with an associated excavating implement which is used for cutting the trench.
Figure 5:
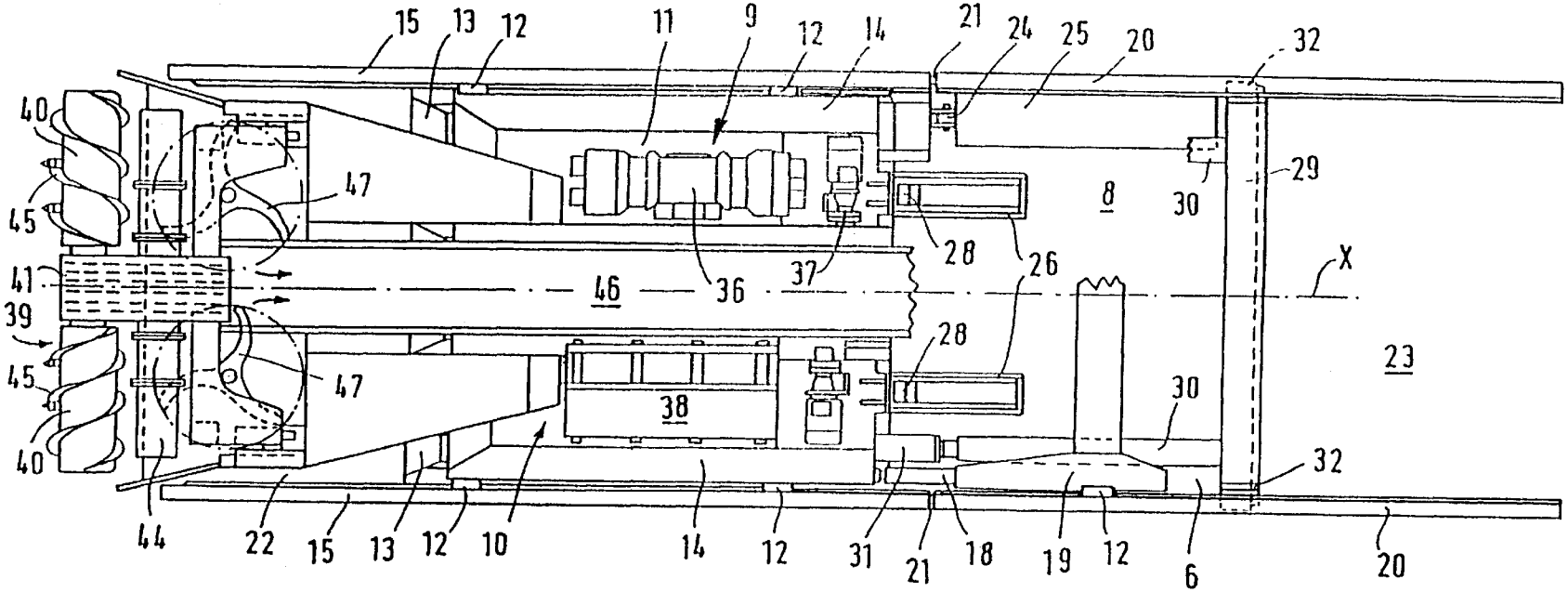
FIG. 5 is a view similar to that in FIG. 3 but showing the sliding cutting structure according to FIG. 4.

The cutting structure shown in FIGS. 4 and 5 differs from that in FIGS. 1 to 3 substantially in that cutting of the trench in the frontal working space 22 is carried out by means of an excavating implement 39 mounted on the supporting or leading frame 10 and which in the example illustrated comprises two equi-axial driven cutting cylinders 40 which are mounted for vertical movement on a common pivot arm 41 which is in turn mounted in a pivot mounting 48 on the supporting or leading frame 10 with a horizontal pivoting axis, the vertical pivoting taking place by means of at least one hydraulic pivot cylinder 43. Reference numeral 44 indicates the drive of the cutter rollers 40 which have on their outer shell a conveyor spiral 45 fitted with cutting tools and which feeds the detached material to a conveyor 46 which carries it away from the working area of the trench, e.g. to a processing station so that after processing it can at least partly be used for making the new track bed. Shifting the excavated material loosened by the rotating cutters 40 and moving it onto the clearing conveyor 46 can be achieved by means of powered loading arms 47 rotatably mounted on a loading ramp on both sides of the pick-up end of the clearing conveyor 46, behind the excavating implement 39.

By means of the aforedescribed method, it is possible to reconstruct railway track systems at a high rate of progress (in the direction of the arrow A) and reliably, the sliding cutting structure described securing the trench dependably in the respective working area. What is important above all is that the side slope of the track bed indicated at 5' in FIG. 1, on the side of the track 2 which is kept open for rail traffic, should be reliably held by the inner side cutters 15 which are located at this point and also their trailing cutters 20 and for the sliding cutting structure 9 to follow the track run or track access of the old track which is to be renewed without any bracing at 5' being lost. The cutting structure described provides for adequate control movements. Such control movements, in the case of the structure described, can readily be carried out, for example by an appropriate sequence in the forward driving of the front or side cutters, during which the supporting or leading frame 20 which absorbs the forces of reaction of the cutting cylinders, undergoes a negligible oblique positioning within the trench which counteracts the drifting tendency of the cutting structure towards the side opposite the slope 5'. Also, such corrections can be carried out by means of the displacement cylinders 31 of the pressure and levelling beam when this is able to be braced against the side of the working space 23. In this case, by individual operation or even by oppositely directed action on the two displacement cylinders 24, a positional change or correction of the supporting or leading frame 10 and thus also of the cutters guided thereon can be carried out. The same is possible by means of the hook-in claws 26, for example so that only one of the two claws 26 is in an engaged position so that the supporting frame 10 can have its position influenced by the various working cylinders. Furthermore, it is possible at the front end of the side cutters 15 which brace the side slope 5' to dispose a wedge-shaped shoe 15' (FIG. 2) which during the time this or these side cutter(s) is/are being driven forward, within the framework of the clearance available in the cutter guides, so there is a slight inclination of the cutters in the sense of correcting the course of the cutting structure. It is also possible for the supporting or leading frame 10 to be made slightly conical so that it tapers conically to the rear so that the frame, while in the trench 6, can be easily given an inclined attitude in respect of the trench access X in order to carry out the said control movement. Finally, it is also possible for the side cutters to shift in their cutter guides with a clearance in the transverse direction of the trench so that for example by means of small hydraulic control cylinders, the position of the side cutters can be varied in relation to the supporting frame in order to carry out controlling corrections. As mentioned above, when the cutting structure is being propelled, the pressure and levelling beam 29 can be braced in the trench 6 to act as an abutment so that its displacement cylinders 31 can be used for pushing the supporting or leading frame 10 forwards or, during forwards working of the front cutters, the supporting or leading frame 10 can be braced towards the rear by means of the displacement cylinders 31 and the pressure and levelling beam 29. The pressure and levelling beam 29 can also be supported on a working implement, e.g. on a riddling plate by means of which the bulk crushed material incorporated into the working space 23 to prepare the new track bed can be compressed. Furthermore, it is also possible to dispose on the pressure and levelling beam 29 clamping means for example hydraulically actuated clamping cylinder units or the like by means of which the pressure and levelling beam 29 can be braced laterally in relation to the trailing cutters 20 or the trailing cutters 20 can be pressed against the trench walls. Also by using this measure, the pressure and levelling beam 29 can be used as a bracing abutment. By this measure, it is also possible to improve the securing of the trench walls in the region of the trailing cutters 20. It will be understood that with this bracing or clamping of the pressure and levelling beam 29 in the guides 12 of the trailing cutters, a movement clearance of sufficiently large dimensions must be available. According to a further development feature of the invention, the pressure and levelling beam 29 can, by means of locking elements or the like, be fixed on the two trailing bottom cutters 25 so that it can constitute the said bracing abutment during forwards travel of the supporting or leading frame 10 in the working direction A. The bottom cutters 13 and/or the trailing bottom cutters 25 can be provided on their under side with claw-like elements, e.g. spikes, so that under the weight of the trailing frame 19, they are pressed into the floor 8 of the trench and so assist with the forward feed movement of the supporting or leading frame 10 in the working direction A. These spikes are ideally so constructed as a system of obliquely cut teeth that they do not notably hamper the forward movement of the bottom cutters in the working direction A but prevent them moving backwards during forwards travel of the supporting or leading frame 10. Furthermore, it is possible so to construct the trailing frame 19 that it can be clamped or fixed in the trench 6. This can be achieved by means of a claw-like engaging means disposed on the trailing frame 19, for example on the lines of the hook-in claws 26. In this case, it may be possible even to dispense with hook-in claws 26 disposed on the supporting or leading frame. Furthermore, it is possible to provide on the trailing frame 19 clamping means, e.g. hydraulic clamping cylinder units by means of which the trailing cutters 20 can be pressed against the trench walls. By means of these clamping means, the trailing frame 19 can also assume an abutting function during travel of the leading frame. In this respect, its follow-on cylinders 18 can be used for moving the supporting or leading frame 10 forwards in the working direction A.

As particularly FIG. 2 shows, the length of the side cutters 15 like the length of the trailing cutters 20 is in each case greater than the length of the supporting or leading frame 10, for example by 1.5 to two times. The length of the side cutters 15 can be at least approximately equal to or even greater than the length of the trailing cutters 20. FIG. 1 shows that on both sides of the supporting or leading frame 10 there is in each case only one single side cutter 15. The width (height) of the side cutters 15 corresponds substantially to the depth of the trench 6. Furthermore, FIG. 1 shows that the entire supporting and leading frame with the cutters 13, 15 disposed thereon is inclined in keeping with the inclination of the trench floor 8 and that the side cutters 15 are mounted and guided at an acute angle of inclination in respect of the vertical in so far as their position on the supporting or leading frame 10 is concerned.

We claim:

1. A method of reconstructing railway track systems, whereby while clearing away a bed of an old track, a trench with side walls and a bottom is cut and the trench proceeds in a forward direction along a path of the old track, materials for making a bed of a new track being fed into the trench, characterized in that for safeguarding the trench, a sliding cutting structure is used with bottom cutters resting on the trench bottom and with side cutters which serve to safeguard the side walls of the trench, the bottom cutters and the side cutters guided on a supporting frame ad being advanced under pressure by means of cutter cylinders disposed between the side cutters, the bottom cutters and the supporting frame, and the supporting frame big advanced relative to the bottom cutters and the side cutters by the cutter cylinders.

2. A method according to claim 1, characterized in that the trench bottom is cut with a gradient towards a side of the trench.

3. A method according to claim 1, characterized in that behind the sliding cutting structure, the trench bottom is levelled out by a pressure and levelling beam coupled for displacement with the sliding cutting structure.

4. A method according to claim 1, characterized in that in the protection of the cutting structure, the materials for making the new track bed are fed into a region of the rear ends of the side cutters with respect to said forward direction.

5. A method according to claim 1, characterized in that a directionally controllable multi-part cutting structure is used in which the supporting frame forms an advancing frame, a trailing frame for guiding trailing cutters which are articulatingly connected to the side cutters, the trailing frame being connected to the advancing frame by hydraulic follow-on cylinders for moving the trailing frame in said forward direction relative to said advancing frame.

6. A method according to claim 5, wherein said trailing cutters include trailing bottom cutters, characterized in that the trailing frame slides on at least one of the bottom cutters and the trailing bottom cutters which are articulatingly connected to the bottom cutters.

7. A method according to claim 1, characterized in that from a rear working space of the sliding cutting structure the materials for making the new track bed are deposited on the trench bottom in a plurality of layers.

8. A method according to claim 1, characterized in that the trench is cut by means of an excavating implement disposed on the supporting frame.

9. An apparatus for reconstructing a railway track system comprising a sliding cutting structure for cutting and securing a trench with side walls and a bottom for making a new track bed, a supporting frame for guiding the sliding cutting structure, bottom cutters and side cutters supported on said supporting frame for displacement in opposite directions relative thereto, and cutter cylinders supported on the supporting frame for displacing said bottom cutters and said side cutters.

10. An apparatus according to claim 9, characterised in that the side cutters are longer than the bottom cutters, projecting at the front and rear beyond the supporting frame and beyond the bottom cutters.

11. An apparatus according to claim 9, characterised in that the bottom cutters disposed at a close lateral spacing from one another substantially cover the entire area of the trench bottom.

12. An apparatus according to claim 9, characterized in that the supporting frame has a substantially U-shaped cross-section including a flat frame part forming the web of the U and having an underside, the under side of the flat frame part comprising cutter guides for the bottom cutters, and the supporting frame including side parts forming the arms of the U and over the flat frame part, the side parts comprise side guides for the side cutters.

13. An apparatus according to claim 9, characterized in that the supporting frame of the sliding cutting structure forms a leading frame, a trailing frame coupled to the leading frame by hydraulic follow-on cylinders, the side cutters are guided on the leading frame and the trailing cutters are guided on the trailing frame, and the side cutters and the trailing cutters are rotatable joined.

14. An apparatus according to claim 13, characterised in that the trailing frame has a shorter overall length than the leading frame.

15. An apparatus according to claim 13, characterized in that the bottom cutters are rotatably joined to trailing bottom cutters, the trailing bottom cutters supporting the trailing frame.

16. An apparatus according to claim 13, characterized in that the trailing cutters project rearwardly beyond the trailing frame.

17. An apparatus according to claim 13, characterized in that hook-on claws are retractably mounted on at least one of the leading frame and the trailing frame for selective engagement with the trench bottom.

18. An apparatus according to claim 17, characterized in that the hook-on claws are disposed at the rear of said at least one of the leading frame and the trailing frame and on both sides of a central axis of said at least one frame.

19. An apparatus according to claim 17, characterized in that cylinder means are provided between the hook-on claws and the supporting frame or leading frame for displacing the claws against the trench floor.

20. An apparatus according to claim 9, characterized in that the sliding cutting structure comprises a pressure and levelling beam, the pressure and levelling beam is behind the supporting frame for movement over the trench bottom, and the pressure and levelling beam is coupled to the supporting frame by hydraulic rams.

21. An apparatus according to claim 20, characterized in that the pressure and levelling beam is guided on at least one of the side cutters and trailing cutters.

22. An apparatus according to claim 9, characterized in that a substantially vertically pivotable excavation implement for trench cutting is disposed on the supporting frame together with a clearing conveyor.

23. An apparatus according to claim 9, characterized in that on the supporting frame is at least one hydraulic pump assembly.

24. An apparatus according to claim 9, characterized in that the supporting frame has a front and a rear and tapers conically towards the rear.

25. An apparatus according to claim 17, characterized in that the hook-on claws can be actuated independently of one another.

26. An apparatus according to claim 9, characterized in that the side cutters include trailing cutters and at least one of the side cutters and the corresponding trailing cutters can be operatively applied against the side walls of the trench.

27. An apparatus according to claim 9, characterized in that the side cutters have front ends and at least one of the side cutters has a wedge-shaped cutting edge at the front end thereof.

28. An apparatus according to claim 20, characterized in that the pressure and levelling beam comprises means for forming a bracing abutment in the trench.

29. An apparatus according to claim 20, characterized in that the pressure and levelling beam comprises clamping means for bracing against the side walls of the trench.

30. An apparatus according to claim 20, characterized in that the pressure and levelling beam is mounted on trailing bottom cutters.

31. An apparatus according to claim 13, characterized in that the trailing frame comprises clamping means for acting against the trailing cutters to safeguard the side walls of the trench.

32. An apparatus according to claim 15, characterized in that at least one of the bottom cutters and the trailing bottom cutters can be hooked into the trench bottom by means of claw elements.

33. An apparatus according to claim 9, characterized in that the trench has a depth and the side cutters have a width corresponding substantially to the depth of the trench.

34. An apparatus according to claim 9, characterized in that the length of the side cutters and the length of the trailing cutters is greater than the length of the supporting frame, the length of the side cutters being at least the length of the trailing cutters.

35. A method of reconstructing railway track systems, in that, while clearing away a bed of an old track, a trench with side walls and a bottom is cut and the trench proceeds in a forward direction along a path of the old track, materials for making a bed of a new track being fed into the trench, whereby for securing the trench, a sliding cutting structure with bottom cutters resting on the trench bottom and side cutters which serve to secure the side walls of the trench are used, the bottom cutters and the side cutters guided on a supporting frame of the sliding cutting structure being propelled in the forward direction by means of cutting cylinders disposed between the bottom cutters, the side cutters and the supporting frame, behind the sliding cutting structure, the trench bottom which is cut with a gradient towards a side of the trench, is levelled by means of a pressure and levelling beam coupled to the supporting frame, the materials for making the new track bed are fed into a rear working space of the sliding cutting structure, the rear working space formed by a region of a rear end of the side cutters, the new track bed comprising a plurality of layers of material.

36. A method according to claim 35, characterized in that a directionally controllable multi-part cutting structure is used in which the supporting frame forms a leading frame, a trailing frame for guiding trailing cutters which are articulating connected to the side cutters, the trailing frame being connected to the leading frame by hydraulic follow-on cylinders whereby the trailing frame is pulled on afterwards in said forward direction in such a way that it slides on at least one of the bottom cutters and trailing bottom cutters which are articulatingly connected to the bottom cutters.

37. A method according to claim 35, characterized in that progressive cutting of the trench is carried out by means of an excavating implement disposed on the supporting frame.

38. An apparatus for reconstructing railway track systems, comprising a sliding cutting structure which follows a path of an old track in a forward direction and which secures a trench with a bottom and side walls which is progressively cut out in the path of the old track, a supporting frame for guiding the sliding cutting structure, bottom cutters and side cutters and associated cutter cylinders supported on the supporting frame whereby the supporting frame has a substantially U-shaped cross-section including a flat frame part forming the web of the U and having an underside, the underside of the flat frame comprising cutter guides for the bottom cutters, and the supporting frame including side parts over the flat frame part forming the arms of the U, the side parts comprise side guides for the side cutters, the sliding cutting structure further comprising a pressure and levelling beam coupled to the supporting frame via hydraulic displacement cylinders for movement over the bottom of the trench.

39. An apparatus according to claim 38, characterized in that the supporting frame of the sliding cutting structure forms a leading frame, a trailing frame, the trailing frame coupled to the leading frame by hydraulic follow-on cylinders, the side cutters are guided on the leading frame, trailing cutters are guided on the trailing frame, the side cutters are articulatingly joined to the trailing cutters.

40. An apparatus according to claim 39, wherein said trailing cutters include trailing bottom cutters, characterized in that articulatingly connected to an outer cutter of the bottom cutters are the trailing bottom cutters and on which the trailing frame is supported.

41. An apparatus according to claim 38, characterized in that the side cutters have a front and a rear and have a greater length than the bottom cutters, and project out the front and the rear beyond the supporting frame and beyond the bottom cutters.

42. An apparatus according to claim 38, characterized in that the supporting frame comprises a substantially vertically pivotable excavating implement for cutting out the trench, together with a clearing conveyor.

43. An apparatus according to claim 38, characterized in that the supporting frame comprises hook-in claws which can be applied against the trench bottom.

44. An apparatus according to claim 38, characterized in that the pressure and levelling beam forms a bracing abutment.

45. An apparatus according to claim 38, characterized in that the pressure and levelling beam comprises means for supporting the trailing cutters.

46. An apparatus according to claim 38, characterized in that the trench has a depth and the side cutters are of a width which corresponds substantially to the depth of the trench.

47. An apparatus according to claim 39, characterized in that the trailing cutters project rearwardly beyond the trailing frame and secure the working space for incorporation of the new track bed.

48. An apparatus according to claim 38, characterized in that the side cutters have a front end and a rear end and at least one of the side cutters have a wedge-shaped cutting edge on the front end of the side cutters.

49. An apparatus according to claim 38, characterized in that the pressure and levelling beam is guided on at least one of the side cutters and trailing cutters, the trailing cutters articulatingly connected to the side cutters.

50. An apparatus according to claim 38, characterized in that the supporting frame tapers conically towards its rear.

51. An apparatus according to claim 38, characterized in that at least one of the side cutters and the trailing cutters can be operatively applied against side walls of the trench, the trailing cutter articulatingly connected to the side cutters.

52. An apparatus according to claim 39, characterized in that the trailing frame comprises clamping means, for supporting the trailing cutters and to press the trailing cutters against the side walls of the trench.

53. An apparatus according to claim 39, characterized in that at least one of the bottom cutters and the trailing bottom cutters can be hooked into the trench bottom by means of claw elements.

54. A method according to claim 7, characterized in that the plurality of layers comprises a layer of fleece, a layer of clay, a compacted layer of sand, and a layer of crushed material.

* * * * *